US006820381B1

(12) United States Patent
Ballough

(10) Patent No.: US 6,820,381 B1
(45) Date of Patent: Nov. 23, 2004

(54) CONCEALED RETAINING CHANNEL FOR STORM SHUTTER ATTACHMENT

(75) Inventor: William E. Ballough, 3585 Lucia Dr., Vero Beach, FL (US) 32967

(73) Assignee: William E. Ballough, Vero Beach, FL (US)

( * ) Notice: Subject to any disclaimer, the term of this patent is extended or adjusted under 35 U.S.C. 154(b) by 0 days.

(21) Appl. No.: 10/773,907

(22) Filed: Feb. 6, 2004

Related U.S. Application Data

(62) Division of application No. 10/005,243, filed on Dec. 5, 2001, now Pat. No. 6,708,457.

(51) Int. Cl.[7] ..... E04B 3/26

(52) U.S. Cl. ..... 52/202; 52/203; 52/94; 52/96; 49/61; 49/62; 248/254; 248/48.1; 248/48.2; 248/208; 248/304; 248/309.1

(58) Field of Search ..... 52/202, 203, 94, 52/96; 49/61, 62; 248/254, 309.1, 48.1, 48.2, 208, 304

(56) References Cited

U.S. PATENT DOCUMENTS

| | | | | | |
|---|---|---|---|---|---|
| 2,504,702 | A | | 4/1950 | Krantz | 20/55 |
| 2,738,040 | A | | 3/1956 | Waldin | 189/62 |
| 2,852,804 | A | | 9/1958 | Alexander | 16/158 |
| 3,206,806 | A | * | 9/1965 | Powell | 52/287.1 |
| 3,745,704 | A | * | 7/1973 | Covington | 49/57 |
| 4,495,726 | A | | 1/1985 | Lindstrom | 49/401 |
| 4,819,390 | A | * | 4/1989 | Capper et al. | 52/95 |
| 4,886,103 | A | | 12/1989 | Baier | 160/178.1 |
| 5,001,875 | A | * | 3/1991 | Cacioppo | 52/201 |
| 5,195,283 | A | * | 3/1993 | MacLeod et al. | 52/95 |
| 5,243,793 | A | * | 9/1993 | MacLeod et al. | 52/95 |
| 5,430,982 | A | * | 7/1995 | Bane | 52/202 |
| 5,457,921 | A | * | 10/1995 | Kostrzecha | 52/202 |
| 5,487,244 | A | | 1/1996 | Hill | 52/202 |
| 5,560,158 | A | * | 10/1996 | Norton | 52/95 |
| 5,560,170 | A | * | 10/1996 | Ganser et al. | 52/539 |
| 5,596,849 | A | | 1/1997 | Hill | 52/202 |
| 5,620,037 | A | | 4/1997 | Apostolo | 160/118 |
| 5,657,585 | A | * | 8/1997 | Zaccagni | 52/94 |
| 5,729,933 | A | * | 3/1998 | Strength | 52/96 |
| 5,740,639 | A | * | 4/1998 | Covington | 52/202 |
| 5,761,860 | A | | 6/1998 | Koike et al. | 52/204.67 |
| 5,768,833 | A | | 6/1998 | Golen | 52/202 |
| 5,797,220 | A | * | 8/1998 | Zaccagni | 52/11 |
| 5,996,292 | A | * | 12/1999 | Hill et al. | 52/202 |
| 6,047,500 | A | | 4/2000 | Caplette | 49/466 |
| 6,079,168 | A | * | 6/2000 | Shaver | 52/202 |
| 6,122,868 | A | * | 9/2000 | Knezevich | 52/202 |
| 6,138,418 | A | * | 10/2000 | Dyer et al. | 52/94 |

* cited by examiner

*Primary Examiner*—Carl D. Friedman
*Assistant Examiner*—Nahid Amiri
(74) *Attorney, Agent, or Firm*—Brian S. Steinberger; Law Offices of Brian S. Steinberger

(57) ABSTRACT

Concealed retaining channel for attaching upper edges of storm shutters in front of windows. The concealed retaining channel can be installed within a soffet portion of a roof overhang, and remains unseen with or without a storm shutter attached thereto. The concealed retaining channel can have a lower facing channel opening for receiving an upper edge of the storm shutter, and can be attached with removable fasteners to an exterior wall above the window being protected by the shutter and above the soffit portion of the roof overhang. A front portion of the concealed retaining channel can have a horizontal planar sleeve with an interior facing groove for receiving an upper leg of an elongated piece of trim, such as J-shaped decorative trim, so that only a portion of the decorative trim hangs down exposing a front facing groove. The rear edge of the soffit portion can fit within the front facing groove of the trim, with the planar sleeve resting on top of the soffit portion so that only a lower portion of the trim remains visible beneath the soffit portion, and the rest of the concealed retaining channel remains unseen.

7 Claims, 5 Drawing Sheets

CONCEALED RETAINING CHANNEL FOR STORM SHUTTER ATTACHMENT

This is a Divisional of application Ser. No.: 10/005,243 filed Dec. 5, 2001 now U.S. Pat. No. 6,708,457 and this invention relates to shutters, and in particular to a retaining channel that is concealed from view by being located within a roof overhang soffit that is used for positioning and attaching an upper end of a storm shutter therein, and the concealed retaining channel provides for receiving a decorative trim such as a J-shaped decorative trim, that remains partially visible below the retaining channel.

This invention relates to shutters, and in particular to a retaining channel that is concealed from view by being located within a roof overhang soffit that is used for positioning and attaching an upper end of a storm shutter therein, and the concealed retaining channel provides for receiving a decorative trim such as a J-shaped decorative trim, that remains partially visible below the retaining channel.

BACKGROUND AND PRIOR ART

Storm shutters are becoming more and more popular to protect structures from storms such as hurricanes, tornadoes, and the like. Typically, storm shutters are attached to exterior walls of structures for protecting windows by fitting the upper end of the shutter into an exposed inverted U-shaped bracket. The exposed inverted U-shaped bracket when not being used can be an undesirable eyesore because it permanently sticks out from under the soffet above the exterior windows. U.S. Pat. No. 2,738,040 to Waldin; U.S. Pat. No. 5,487,244 to Hill; U.S. Pat. No. 5,596,849 to Hill; U.S. Pat. No. 5,620,037 to Apostolo; and U.S. Pat. No. 5,768,833 to Golen show various types of storm shutter attachment techniques having visible mounting hardware.

FIG. 1 is a perspective view of a structure 1 with a prior art storm shutter attachment technique. FIG. 2 is a cross-sectional view of FIG. 1 along arrow A. Referring to FIGS. 1-2, a structure 1 such as a house, building, and the like, uses upper brackets 40 attached to an exterior wall 30 above a window 80, and lower brackets 60 attached to an exterior wall portion 70 below the window 80 near ground level 90 to support a storm shutter panel 50. From outside the structure, the shutter mounting hardware, especially the upper bracket 40, with respective mounting fasteners such as screws, bolts, and the like, will generally always remain visible, since the shutter 50 is mounted to the wall portion 30 of the structure 1, underneath the soffet 20 which is under the roof portion 10. Typically, when the storm shutter(s) 50 are removed, the mounting hardware, especially the upper mounting bracket 40 and fasteners 42 are left on the structure 1. As earlier noted, without the storm shutters, and to a lesser extent with the shutters in place, the upper brackets 40 and respective mounting hardware is an undesirable remnant that always remains visible.

Thus, the need exists for solutions to the above problems with the prior art.

SUMMARY OF THE INVENTION

A primary objective of the invention is to provide upper mounting hardware for storm shutters that is not visible from any side of a structure on which storm shutters are mounted.

A secondary objective of the invention is to provide for mounting an upper portion of a storm shutter into a soffit overhang portion under the roof of a structure.

A third objective of the invention is to provide a concealed retaining channel assembly for mounting an upper portion of a storm shutter which accommodates a partially visible trim mold, such as a J-shaped decorative trim.

A preferred embodiment of the invention includes a novel concealed retaining channel assembly, and a novel method for installing storm shutters so that upper edges of the shutters are hidden and remain concealed within the soffit overhang portions of a roof. The novel method and system includes installing a concealed retaining channel assembly having a lower facing track within a soffet portion above an exterior window, inserting an upper edge of a shutter into the lower facing track, and covering the window with the shutter, wherein substantially all of the retaining channel assembly is concealed from an exterior side of the shutter. The novel system includes inserting a trim mold such as a J-shaped decorative trim into a side groove on the retaining channel assembly. The concealed retaining channel assembly can be attached to an exterior wall above the window with removable fasteners such as screws and bolts. The shutter can also be attached to a wall portion beneath the window by additional removable fasteners and wall mounted brackets.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangements shown since the invention is capable of other embodiments. Also, the terminology used herein is for the purpose of description and not of limitation.

Figure 3:
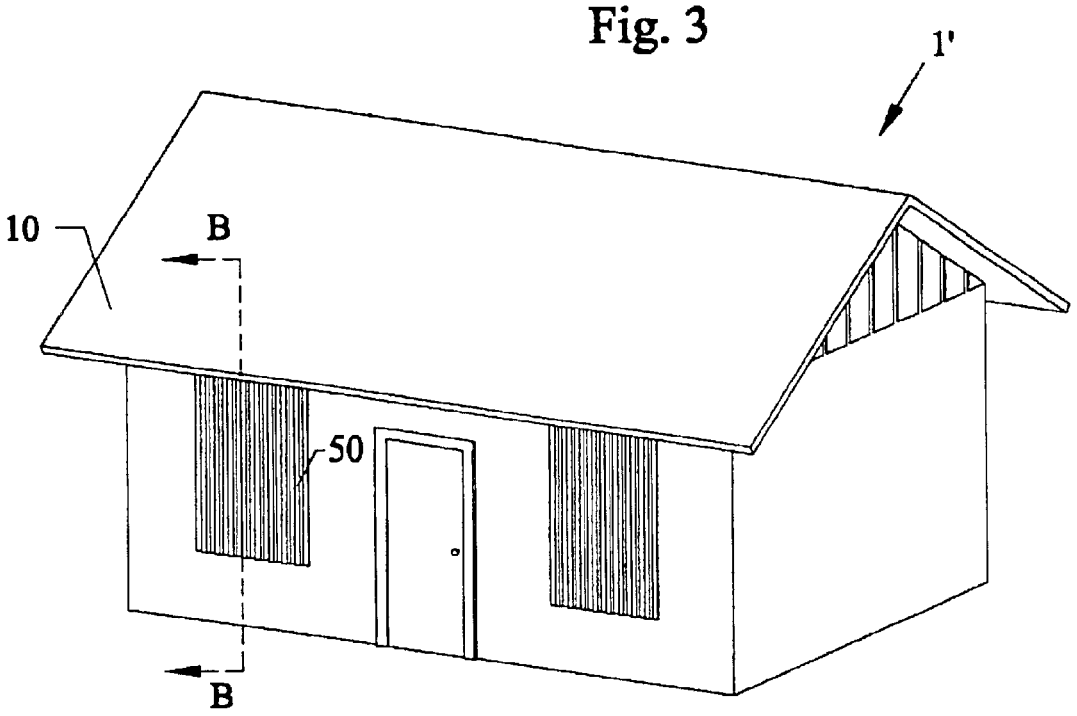
FIG. 3 is a perspective view of a structure using the novel concealed retaining channel storm shutter attachment invention.
Figure 1:
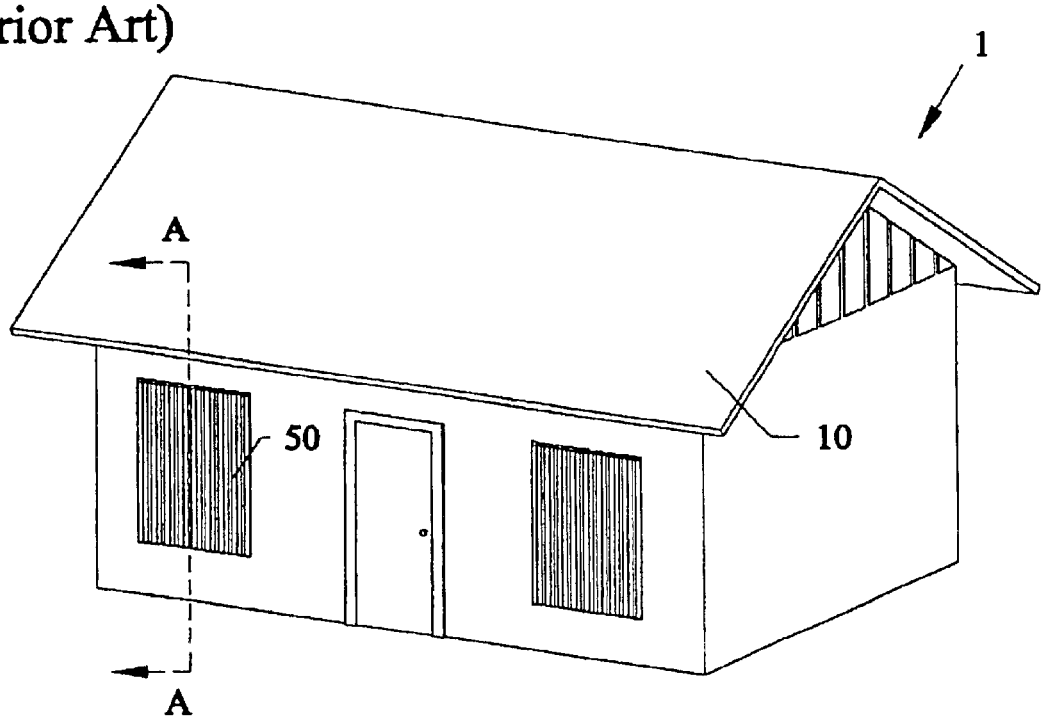
Fig. 1 (Prior Art)
FIG. 1 is a perspective view of a structure with storm shutters attached under the prior art.
Figure 2:
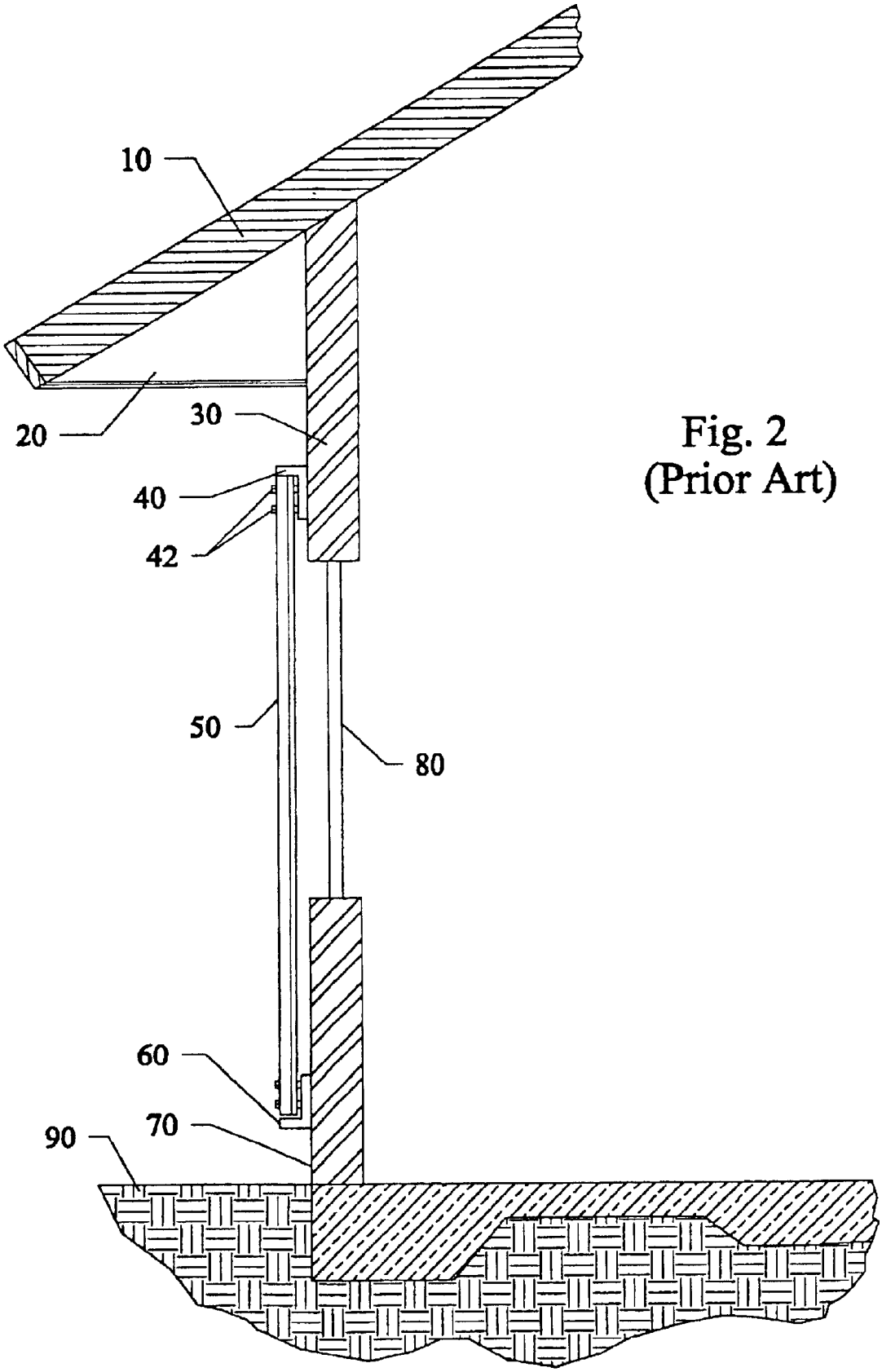
Fig. 2 (Prior Art)
FIG. 2 is a cross-sectional view of FIG. 1 along arrow A of a prior art shutter attachment.
Figure 4:
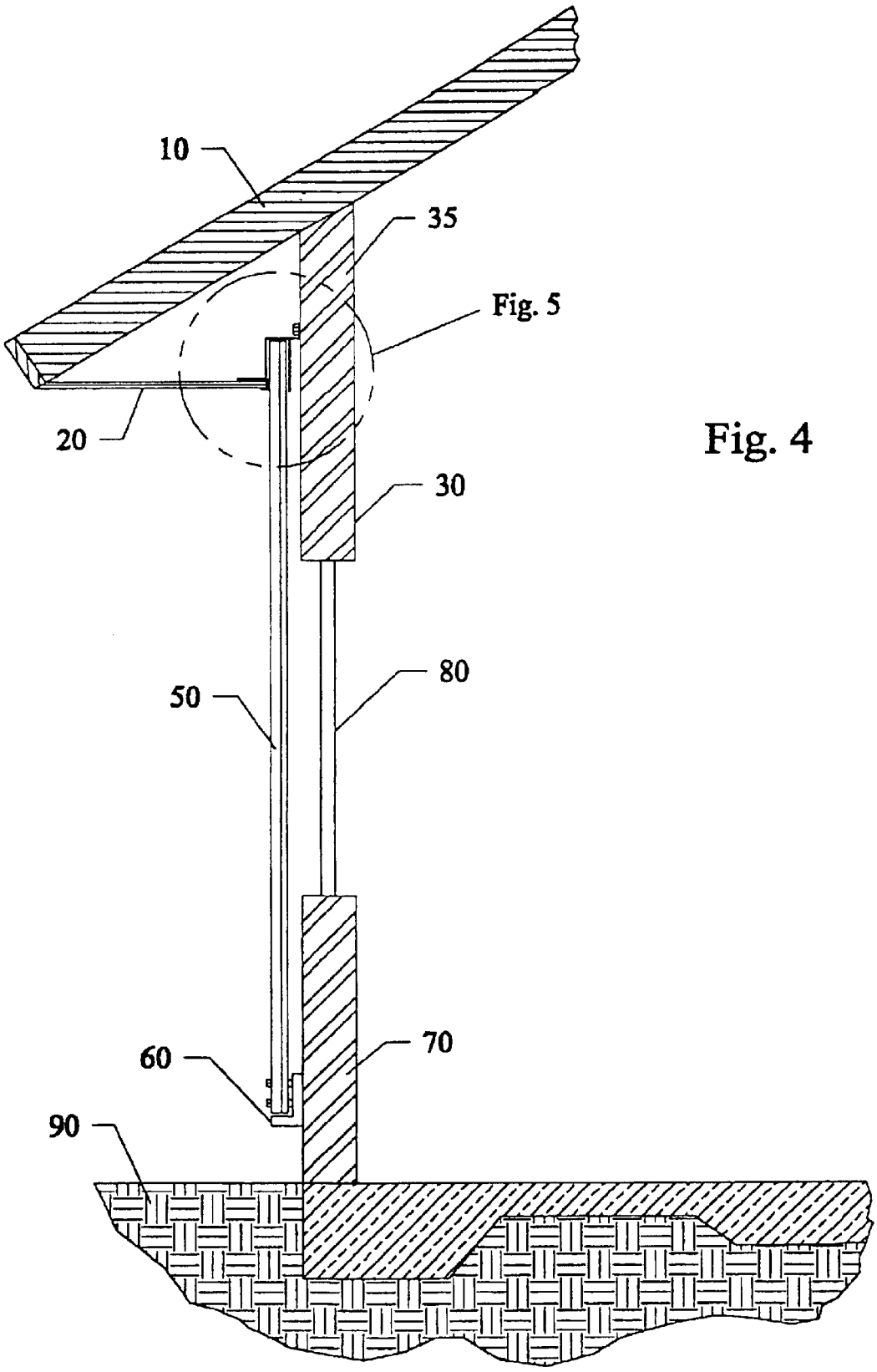
FIG. 4 is a cross-sectional view of FIG. 3 along arrow B.
Figure 5:
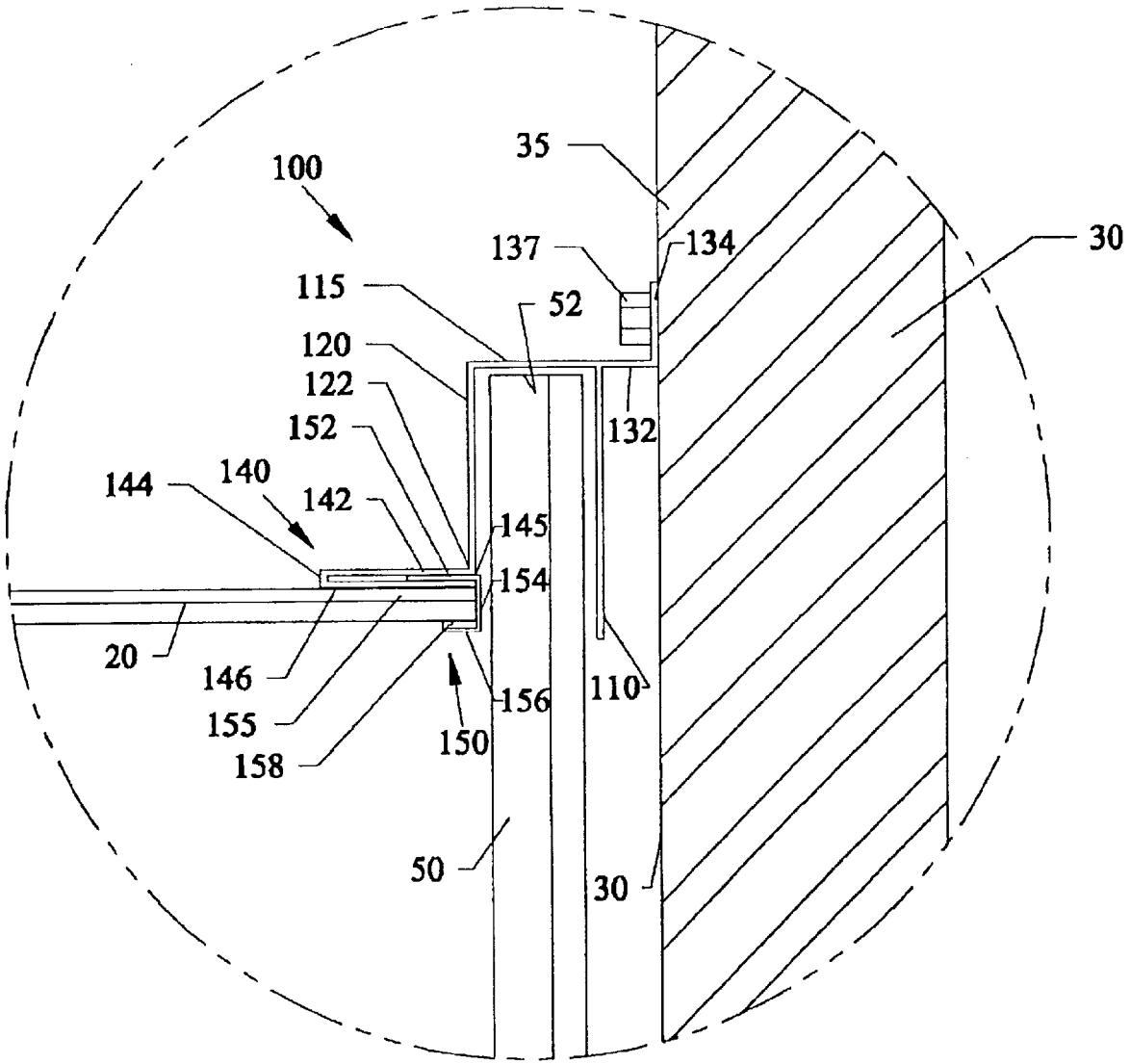
FIG. 5 is an enlarged view of the installed concealed retaining channel storm shutter attachment of FIG. 4
Figure 6:
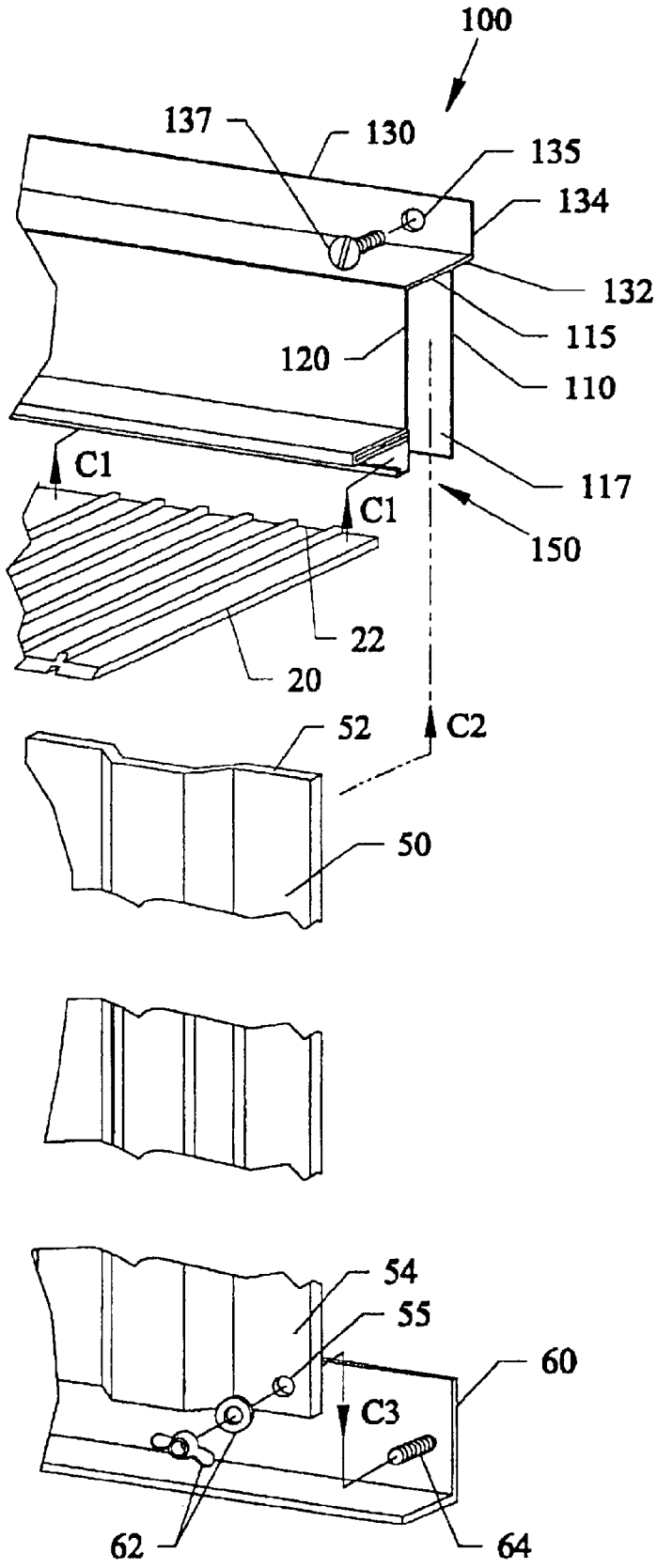
FIG. 6 is an exploded view of soffit, retaining channel storm shutter attachment with J-shaped decorative type trim, shutter, and base mount of FIGS. 3-5.

FIG. 3 is a perspective view of a structure 1' using the novel concealed retaining channel storm shutter attachment invention 100. FIG. 4 is a cross-sectional view of FIG. 3 along arrow B. FIG. 5 is an enlarged view of the novel installed retaining channel storm shutter attachment invention 100 of FIG. 4. FIG. 6 is an exploded view of soffit 20, retaining channel assembly 100 with J-shaped decorative trim 150, shutter 50, and base mount 60, 62 of FIGS. 3-5.

Referring to FIGS. 3-6, the concealing retained channel assembly 100 includes a rear elongated vertical leg 110, front elongated vertical leg 120 and a cap portion 115 attached to upper edges of the front vertical leg 120 and rear vertical leg 110 forming a lower facing channel 117 therebetween. An L-shaped mounting bracket 130 is attached to the cap member 115 and can include a rear facing member 132 and can include an upper perpendicular-mounting member 134. Through-hole(s) 135 in the upper mounting member allow for removable fasteners 137, such as but not limited to screws, bolts, and the like, to attach the retaining channel assembly 100 to an exterior wall portion 35 above a window 80.

A front portion of the concealed retaining channel assembly 100 includes a horizontal planar sleeve 140 attached to a lower edge 122 of front vertical leg 120. Sleeve 140 includes an upper planar plate portion 142, lower planar plate portion 146 and member portion 144 connecting front edges of the upper planar plate portion 142 and lower planar plate portion 146 together with an elongated groove spacing 145 therebetween. An elongated J-shaped decorative type trim 150 has an upper horizontal leg 152 connected to a rear wall portion 154 and lower horizontal leg 156 with an upper facing ridge portion 158, and a front facing groove 155 therebetween.

The installer can insert a rear edge 22 of soffet 20 in the direction of arrow C1 into groove 155 of the J-shaped decorative trim 150 so that the lower planar plate portion 146 of the sleeve 140 rests against an upper surface of the soffit 20. Next, the installer can insert an upper edge 52 of the storm shutter 50 in the direction of arrow C2 into the lower facing channel 117 between rear vertical leg 110 and front vertical leg 120. Finally, the installer can attach a lower edge 54 of the storm shutter 50 to exterior wall 70 beneath window 80. The installer can position through-holes 55 on the lower edge 54 of the shutter 50 to fit about a threaded shaft 64, or a like type fastener. Removable fasteners 62 such as nuts, and washers, can then attach the lower edge 54 of the shutter 50 to exterior wall 70 below window 80. The concealed retaining channel assembly 100 remains hidden within the soffet, while only a portion of the decorative J-shaped trim 150 remains visible below the soffit.

The components of the novel invention can be formed from various materials, such as but not limited to aluminum, galvanized metal, injection molded plastic, and the like, and combinations, thereof.

While the preferred embodiment describes installing the retaining channel into soffit areas above and outside an exterior window, the retaining channel can also be installed in ceilings inside of the structure.

Although, the preferred embodiment can use the lower bracket type mounts of the prior art, the invention can also use lower brackets that are mounted closer to ground level so that the lower brackets are also not generally visible when the shutters are not being used. Thus, the lower brackets can be positioned to be somewhat concealed from view.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method for concealing upper mounts for shutters, comprising the steps of:

installing an attachment mount having a lower facing channel within a soffit portion above a window;

inserting an upper edge of a shutter into the lower facing channel; and covering the window with the shutter, wherein substantially the entire attachment mount is not visible from an exterior side of the shutter.

2. The method of claim 1, wherein the inserting the upper edge further includes the step of:

inserting a portion of an elongated trim into a groove within the attachment mount.

3. The method of claim 2, wherein the elongated trim includes:

a J-shaped decorative trim.

4. The method of claim 1, further comprising the step of:

inserting a horizontal leg portion of the J-shaped decorative trim into a horizontal sleeve portion of the attachment mount.

5. The method of claim 1, wherein the installing step further includes:

attaching the channel to an exterior wall above the window and into the soffit portion.

6. The method of claim 1, wherein the attaching step further includes:

fastening the channel to the exterior wall with removable fasteners.

7. The method of claim 1, further comprising the step of:

attaching a lower edge of the shutter beneath the window.

* * * * *